US005519915A

United States Patent [19]

Hollowell

[11] Patent Number: 5,519,915

[45] Date of Patent: May 28, 1996

[54] VEHICULAR VACUUM COLLECTOR WITH BOOM HEIGHT ADJUSTMENT

[76] Inventor: John R. Hollowell, 8401 Estero Blvd. Apt. 504, Ft. Myers Beach, Fla. 33931

[21] Appl. No.: 466,416

[22] Filed: Jun. 6, 1995

[51] Int. Cl.[6] ..... A47L 9/00

[52] U.S. Cl. ..... 15/354; 15/340.1

[58] Field of Search ..... 15/340.1, 354

[56] References Cited

U.S. PATENT DOCUMENTS

| | | | |
|---|---|---|---|
| 4,066,511 | 2/1977 | Larsen . | |
| 4,099,290 | 7/1978 | Hiszpanski . | |
| 4,193,159 | 3/1980 | Beard, III . | |
| 4,366,594 | 1/1983 | Hyams | 15/340.1 X |
| 4,535,501 | 8/1985 | Hollowell et al. . | |
| 4,643,776 | 2/1987 | Hollowell et al. . | |
| 4,659,262 | 4/1987 | van Aalst | 15/340.1 X |
| 4,868,948 | 9/1989 | Arnold | 15/340.1 |
| 5,138,742 | 8/1992 | Charky | 15/354 X |

*Primary Examiner*—Chris K. Moore
*Attorney, Agent, or Firm*—Harness, Dickey & Pierce

[57] ABSTRACT

The flexible hose of the vacuum trash collector is supported by a leaf spring boom secured to the trash collector canister by the boom height adjustment mechanism. A nozzle at the end of the hose picks up the trash. A hand crank, driving a threaded reciprocative coupling, changes the angle of attachment of the boom to the canister, to raise and lower the boom and thereby allow the operator to set the nozzle height to a comfortable operating position while in the field and without the need to use tools or to dismantle the boom attachment mechanism.

9 Claims, 1 Drawing Sheet

VEHICULAR VACUUM COLLECTOR WITH BOOM HEIGHT ADJUSTMENT

BACKGROUND AND SUMMARY OF THE INVENTION

The present invention relates generally to vacuum collectors of the mobile, vehicular type. More particularly, the invention relates to an improved boom height adjustment mechanism.

In applicant's prior U.S. Pat. No. 3,710,412, entitled "Vacuum Trash Collector," issued Jan. 16, 1973, a cart-mounted, mobile trash collector is illustrated and described. The trash collector employs a flexible hose of inverted U-shape which has a nozzle on its outer end and which is connected at its inner end to the lid of the collection canister or bin. The hose is supported by a leaf spring pivoted at its inner end and the nozzle is controlled by a handle through a telescoping connection.

In applicant's referenced prior patent the leaf spring mechanism was carried on a bracket secured to the inlet portion of the bin lid. The leaf spring assembly was pivotally connected to the bracket to allow pivotal movement about the axis of the coaxial pivots. Up and down movement of the nozzle relative to the surface of the ground was effected by flexing the leaf spring mechanism.

Although the device described in applicant's referenced prior patent permitted the nozzle to be moved to a variety of different positions, the up/down movement, by the nature of the structure employed, required the human operator to flex the leaf spring assembly, which could get tiring for some operators after a full day of use.

To minimize operator fatigue, it would be desirable to establish the nozzle height above the ground in the optimal position, neither too high nor too low. If the nozzle is too high, the operator is constantly flexing the leaf spring assembly downwardly to reach the trash. If the nozzle is too low, the operator will frequently need to flex the leaf spring assembly upwardly to prevent the nozzle from engaging the ground while the vehicle is moving. In prior art devices, including the device illustrated and described in applicant's referenced issued patent, the nozzle height was simply the result of the stiffness of the leaf spring assembly vis-a-vis the weight of the flexible hose, nozzle and the operator's arm. Due to differences in operator body weight, the optimal nozzle height was not always achieved. Thus some prior systems have employed mounting bolts which could be loosened with a wrench to allow manual adjustment of the leaf spring assembly and then retightened for use. Because tools were required and because of the trial and error involved, it was not practical to adjust the nozzle height while the trash collector was in use in the field.

The present invention provides a greatly improved boom height adjustment which employs a combined pivot coupling and a reciprocative coupling. Preferably the pivot coupling and reciprocative coupling are incorporated in a bracket structure by which the boom may be attached to the collection canister or to another fixed location on the vacuum trash collector or its vehicle. A threaded driving means is mounted in fixed relation to the bracket and is operatively coupled to the boom for raising and lowering the height of the nozzle by effecting rotational movement of the boom about the pivot coupling.

For a more complete understanding of the invention, its objects and advantages, reference may be had to the following specification and to the accompanying drawings.

DESCRIPTION OF THE PRESENTLY PREFERRED EMBODIMENT

Figure 1:
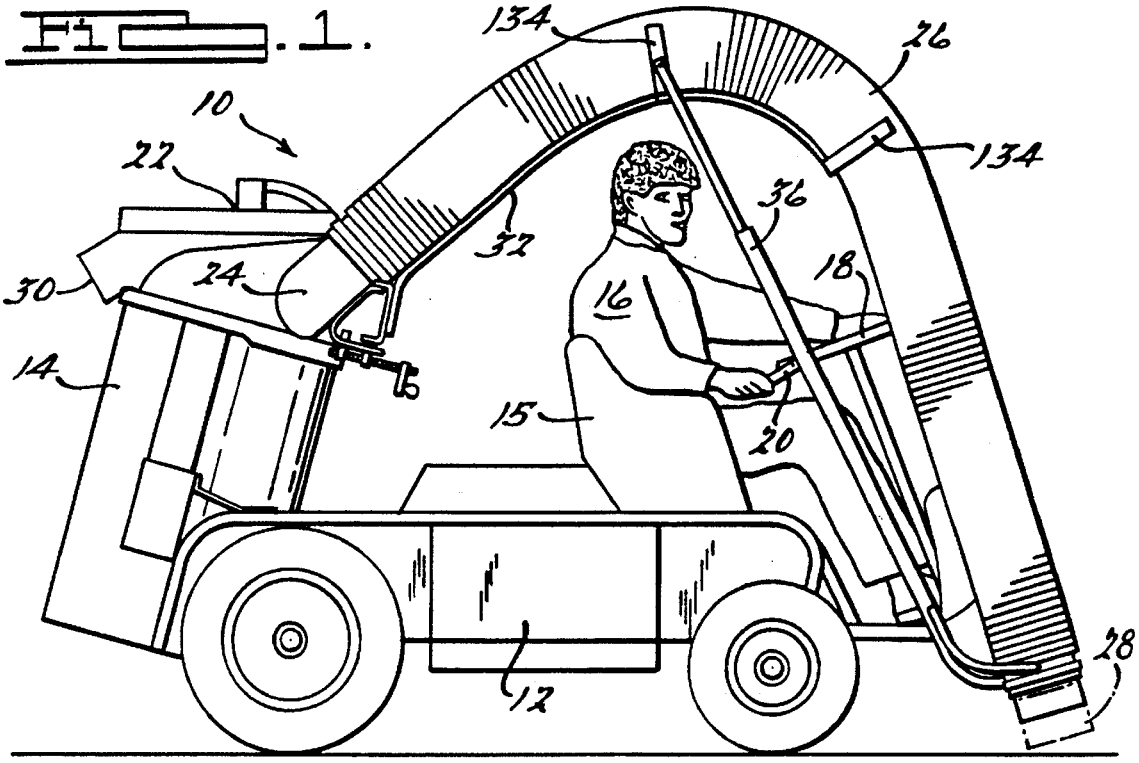
FIG. 1 is a side elevation view of the vacuum trash collector which features the improved boom height adjustment means of the invention.

Referring to FIG. 1, the vacuum trash collector is illustrated generally at 10. As illustrated the trash collector is preferably of the type having a self-propelled, four-wheel vehicle or car 12 on which is carried a canister 14. Preferably the canister is located at the rear of car 12. The human operator 16 sits in the front of the car where the steering wheel 18 and nozzle positioning handle 20 are conveniently located.

The presently preferred vacuum trash collector includes a vacuum blower unit 22 which comprises the lid of canister 14. The illustrated embodiment employs a hydraulically-driven vacuum blower, although gasoline engines and electric motors may also be used. The vacuum blower unit has an inlet port 24 to which a corrugated flexible vacuum hose 26 is attached at its proximal end. The distal end of vacuum hose 26 forms a nozzle 28. Vacuum blower unit 22 is also provided with an outlet port 30 through which air from the blower unit is expelled.

Vacuum hose 26 arches above the seat 15, thus leaving room for the operator to sit, and then extends downwardly as illustrated. A U-shaped leaf spring boom 32 is disposed beneath the vacuum hose 26 to support the hose in its arched configuration. Preferably boom 32 comprises a leaf spring having one or more U-shaped support cradles 134 to hold the vacuum hose in place. A telescoping rod 36 is connected between one of the support cradles and the nozzle, as illustrated. The telescoping rod is provided with the laterally projecting positioning handle 20.

Figure 2:
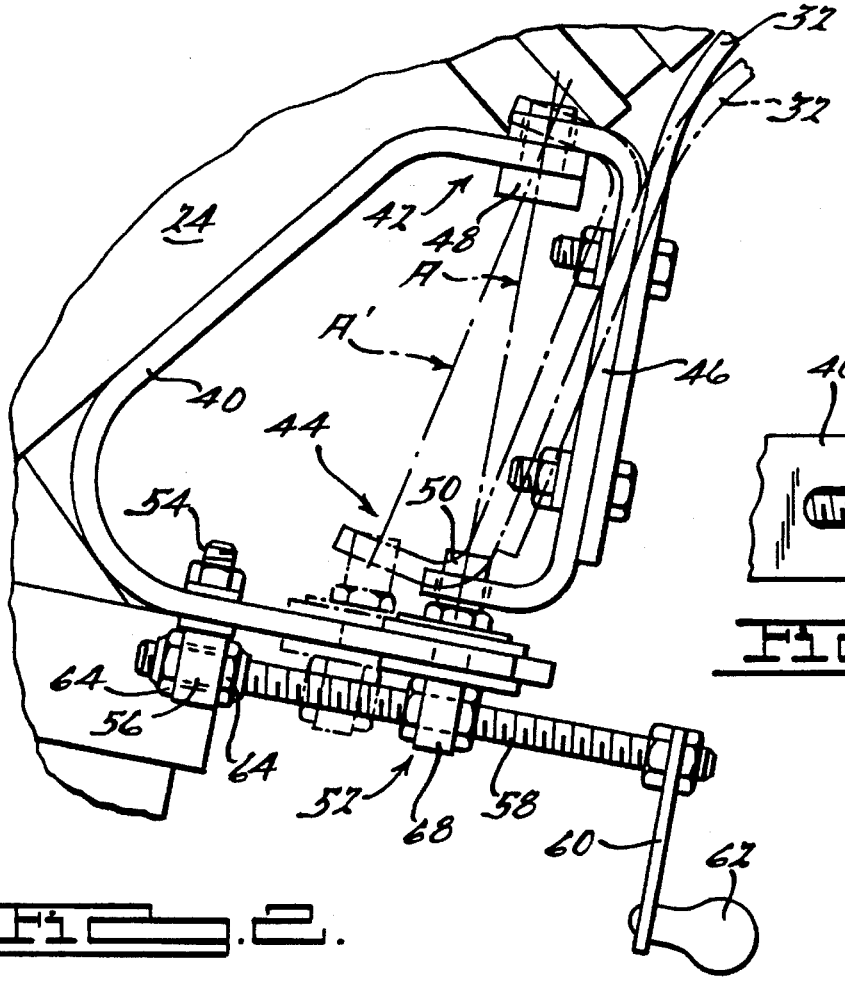
FIG. 2 is an enlarged partial elevation view of the boom height adjustment mechanism.

Referring now to FIG. 2, the details of the boom height adjustment structure will now be described. A stationary boom-holding bracket 40 is suitably secured in fixed relation to canister 14, such as by screws, bolts or welding to the inlet port 24. The boom-holding bracket defines a pivot coupling 42 and a reciprocative coupling 44. Boom 32 is provided at its proximal end with a generally U-shaped hinge bracket 46, which may be secured to boom 32 as with bolts. A first attachment means in the form of a loose-fitting pivot pin 48 secures the boom via bracket 46 to pivot coupling 42 at the upper end of hinge bracket 40. A second attachment means in the form of an elongated pivot pin 50 secures the boom via bracket 46 to the lower end of bracket 40. Pivot pins 48 and 50 define an axis of rotation about which the boom is free to swing. Preferably this axis of rotation, designated axis A (and in an alternate position, A'), is generally vertical with respect to the ground.

The boom height adjustment means further includes a threaded driving mechanism shown generally at 52. The threaded drive mechanism is mounted in fixed relation to the bracket 40, preferably by means of the fixed anchor bolt 54 which is provided with a loose-fitting, nonthreaded guide aperture 56 through which the end of screw 58 is installed. Opposite the fixed anchor bolt, screw 58 is provided with a crank 60 having a handle 62 which the human operator can turn to rotate the screw about its longitudinal axis. A pair of jammed nuts or nylon locking nuts 64 are fitted onto screw 58 on both sides of the fixed anchor bolt. These nuts hold the screw 58 in a fixed position so that the screw will not travel longitudinally when the crank is turned.

Figure 3:
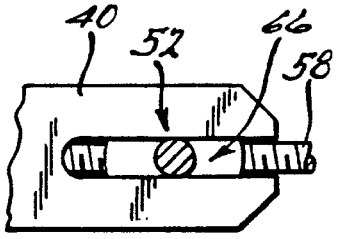
FIG. 3 is a detailed cross-sectional view of the lower end of the boom-holding bracket, showing the slotted opening of the reciprocative coupling.

The lower end of boom-holding bracket 40 which comprises the reciprocative coupling is provided with an elongated, slotted opening 66 (FIG. 3) through which pivot pin 50 passes. Pivot pin 50 is in turn secured to a threaded drive coupling 68 which is adapted to travel longitudinally back and forth on screw 58.

In operation, adjustment of the boom height is easily effected by turning crank 60 to cause the threaded coupling 68 to travel longitudinally following the threads of screw 58. This in turn slidably repositions the elongated pivot pin thereby changing the angle of the hinge bracket relative to the stationery boom-holding bracket. (Compare axis A with axis A'.) Because pivot pin 48 is loose-fitting, this longitudinal adjustment of the reciprocative coupling results in rotational movement of the boom about the pivot coupling, thereby raising or lowering the height of the nozzle, depending on the direction the crank is turned.

While the invention has been described in its presently preferred embodiment, it will be understood that certain modifications can be made without departing from the spirit of the invention as set forth in the appended claims.

What is claimed is:

1. In a vacuum collector of the type having a collection canister mounted on a vehicle and having a hose connected at one end to the canister and being open at the other end to form a collection nozzle and having a boom extending from said vehicle and attached to said hose for supporting the hose during use, the improvement comprising:

boom height adjustment means, comprising:

bracket means mounted in fixed relation to said canister, said bracket means defining a pivot coupling and a reciprocative coupling;

first attachment means for securing said boom at a first location to said pivot coupling second attachment means for securing said boom at a second location to said reciprocative coupling;

threaded driving means mounted in fixed relation to said bracket means and operatively coupled to said boom for raising and lowering the height of said nozzle by effecting rotational movement of said boom about said pivot coupling.

2. The improvement of claim 1 wherein said pivot coupling is disposed above said reciprocative coupling.

3. The improvement of claim 1 further comprising hinge bracket attached to said boom and mounted in a movable relation to said canister and wherein said first and second attachment means cooperate with said hinge bracket to define a generally vertical axis of rotation about which said boom may rotate to effect side to side movement.

4. The improvement of claim 1 wherein said threaded driving means includes crank means accessible to the vehicle operator for operating said driving means.

5. The improvement of claim 1 wherein said bracket means defines a slotted opening for defining at least a portion of said reciprocative coupling.

6. The improvement of claim 5 wherein said reciprocative coupling further includes a pin means carried in and slidable within said slotted opening.

7. The improvement of claim 1 wherein said pivot coupling includes a pin means secured to said bracket and coupled to said first attachment means.

8. The improvement of claim 1 wherein said first attachment means comprises a bracket means secured to said boom and having means for movably attaching to said pivot coupling.

9. The improvement of claim 1 wherein said second attachment means comprises a bracket means secured to said boom and having means for movably attaching to said reciprocative coupling.

* * * * *